United States Patent [19]

Schacht

[11] Patent Number: 4,502,644

[45] Date of Patent: Mar. 5, 1985

[54] PULL-OFF AID FOR DRAWING THREADS FROM BOBBINS

[76] Inventor: Dieter Schacht, Ev. Kirchstr. 35, 4152 Kempen 4, Fed. Rep. of Germany

[21] Appl. No.: 286,599

[22] Filed: Jul. 24, 1981

[30] Foreign Application Priority Data

Aug. 5, 1980 [DE] Fed. Rep. of Germany ..... 3029598

[51] Int. Cl.[3] ..... B65H 49/14; D03J 5/10

[52] U.S. Cl. ..... 242/129.8; 242/130.4

[58] Field of Search ..... 242/128, 129.8, 129.72, 242/129.71, 129.7, 129.5, 129.53, 171, 172, 129.62, 147 R, 125, 125.3, 130, 130.1, 131; 57/352, 3, 16, 17, 18, 15, 59

[56] References Cited

U.S. PATENT DOCUMENTS

| | | | |
|---|---|---|---|
| 860,326 | 7/1907 | Prue | 242/129.5 |
| 2,953,318 | 9/1960 | Hasler et al. | 242/147 R X |
| 3,284,024 | 11/1966 | Franzen | 242/147 R X |
| 3,677,489 | 7/1972 | Dilling | 242/129.72 |

FOREIGN PATENT DOCUMENTS

| | | | |
|---|---|---|---|
| 1041841 | 10/1958 | Fed. Rep. of Germany | 242/128 |
| 2827853 | 1/1980 | Fed. Rep. of Germany | 242/128 |
| 2827814 | 7/1980 | Fed. Rep. of Germany . | |
| 867482 | 5/1961 | United Kingdom | 242/128 |

*Primary Examiner*—Harvey C. Hornsby
*Assistant Examiner*—Scott J. Haugland

[57] ABSTRACT

A pull-off aid (9) for threads drawn overhead from upper and lower bobbins (4,3) comprises a disc of adjustable diameter, the disc periphery engaged by the thread from the lower bobbin (3) being formed by overlapping petal-like segments (10) radially displaceably guided between a lower support disc (11) and an upper carrier disc (12). The inner edges of the segments engage a cam (21) fixed to a bobbin carrier (2). The adjustable diameter disc (9) is received on the lower bobbin core which rests on a centering sleeve (6). The latter is supported by a spring (5) so that as the bobbins become smaller, and therefore lighter, the adjustable diameter disc (9) is lifted by the spring (5) so that the inner edges of the segments ride up the cam (21) and are gradually retracted by a garter spring or rubber ring (18). The diameter of the disc (9) is thereby gradually reduced as the diameter of the bobbins becomes smaller.

15 Claims, 12 Drawing Figures

Fig.10
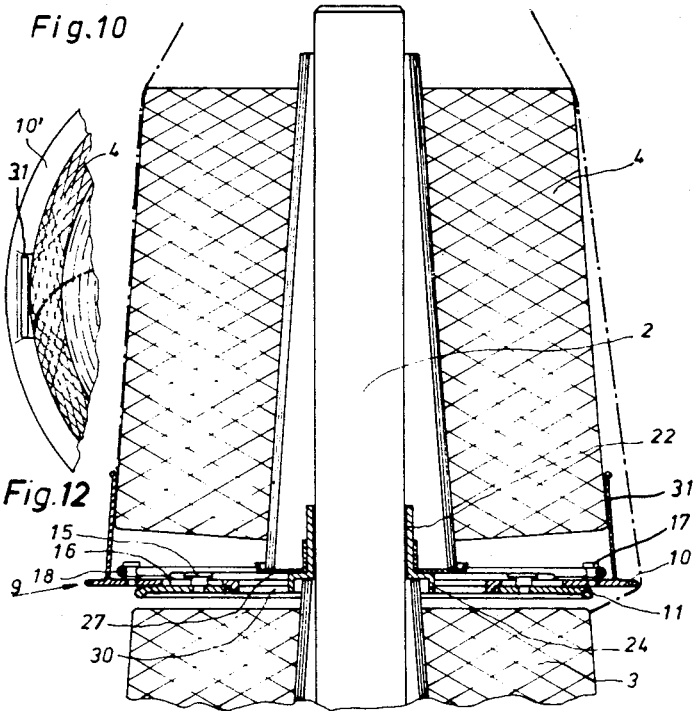
Fig.12
Fig.11
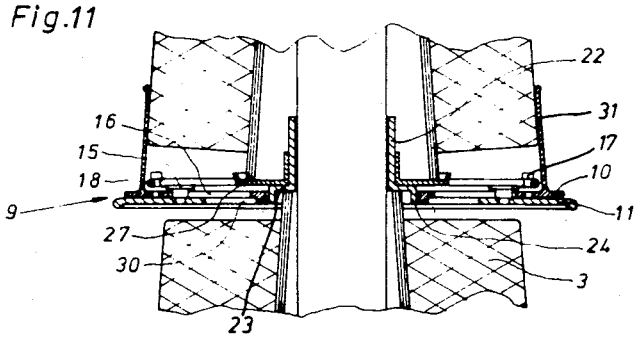

PULL-OFF AID FOR DRAWING THREADS FROM BOBBINS

The invention relates to a pull-off aid for threads drawn overhead from at least two yarn packages or supply bobbins which are disposed coaxially, one above the other, which pull-off aid is in the form of at least one disc which can be slipped onto a bobbin carrier and whose periphery is constituted by a plurality of partially mutually overlapping segments having arcuate outer rims.

BACKGROUND AND OBJECTIVES OF THE INVENTION

German Patent Specification (Offenlegungsschrift) No. 1,510,976 describes a pull-off aid for drawing threads overhead from bobbins of all kinds with the use of an inherently flexible body whose rim is resiliently deformable under the tensile forces exerted by the thread. This disc is generally made from a plastic material and its edge is flexed or bent upwardly by the running thread, whereby the rim of the disc is automatically adapted to the decreasing diameter of the bobbin from which the thread is drawn. This pull-off aid, in the form of a resilient disc, can also be used when the threads are to be guided past the flanks of the bobbins when two or more bobbins are mounted coaxially, one above the other, with the resilient disc disposed between the bobbins. This effectively prevents the thread from the lower bobbin from sliding along the flank of the upper bobbin, preferably in the case of cylindrical bobbins, when, for example, the thread is pulled off overhead.

Thus, the solution in accordance with German Offenlegungsschrift No. 1,510,976 is based on the use of a resilient plastic disc serving as a pull-off aid, such that the plastic disc is deformed in the direction of the take-off of the thread by the tension of the thread resulting from the draw-off forces. The take-up tension of the thread exerts a radial force on the rim of the disc. This radial force causes the disc to flex or bend upwardly until the resilient counter-force of the disc counterbalances this radial force. When two bobbins are mounted one above the other, the disc which is bent up by the draw-off force of the thread from a lower bobbin is applied around the rim of the bobbin located thereabove and thus prevents the thread from the lower bobbin from sliding over the edges of the upper bobbin. Moreover, the tension of the thread from the lower bobbin is affected by the projecting rim of the disc.

However, the known pull-off aids in the form of discs made from resiliently deformable material and having continuous peripheral rims, are still not sufficiently resilient to be able to yield to an adequate extent in the direction in which the thread is drawn off.

German Patent Specification (Offenlegungsschrift) No. 28 27 814 describes a pull-off aid in the form of a disc whose circumferential region comprises a plurality of laminae or segments which are disposed in a fan shape and which partially overlap one another. The elasticity of the rim of the disc is increased as a result of splitting up the outer rim of the disc into a plurality of mutually overlapping laminae or segments, since the thread need only flex or bend upwardly one or two of the mutually overlapping elements more or less only at individual locations. The function of this known pull-off aid has proved to be extremely advantageous in operation, since it can be used to obtain maximum adaptation to varying bobbin diameters, that is to say, decreasing bobbin diameters. However, it may also be seen that, as a result of the required flexibility of the individual laminae or segments, the disc is an element which lacks robustness particularly in the region of its periphery, so that the sensitive rim of the disc can be readily damaged particularly when mounting and handling it, that is to say, when slipping discs of this kind onto a spindle.

German Patent Specification (Offenlegungsschrift) No. 28 27 853 describes a pull-off aid in the form of a substantially rigid annular body which is movable in a radial and lateral direction about the axis of the bobbin. However, it is impossible to adapt the external nominal diameter to, for example, varying bobbin diameters.

An object of the invention is to design a pull-off aid for threads drawn off overhead from at least two coaxial bobbins of the kind described initially, such that it is possible to dispense with flexible and thus sensitive outer rim elements, adaptation to changing, that is to say, decreasing diameters of the feed bobbins, nevertheless being ensured.

A pull-off aid in accordance with the invention comprises at least one disc which can be slipped on to a bobbin carrier and whose periphery is formed by the outer rims of partially mutually overlapping segments which are radially displaceably mounted so that the outer diameter of the disc is adjustable.

It is thus possible to adapt the external diameter of the disc-shaped pull-off aid to varying diameters of the bobbins.

Preferably, the radial displacement of the overlapping segments is controllable in dependence upon the weight of the bobbins or upon the external diameter of the bobbins, or alternatively, in dependence upon time.

In order to render the radial displacement of the overlapping segments, and thus the change in the external diameter of the pull-off aid, independent of the force applied to the pull-off aid by the thread and dependent upon the tension of the thread, the pull-off aid preferably has a resilient element which is effective in the axial direction of the disc and which is loaded by the weight of at least one of the supply bobbins which are mounted one above the other for the purpose of controlling the radial displacement of the segments. In this manner, it is ensured that the external diameter of the pull-off aid is forcibly adapted to changing, that is to say, decreasing diameters of the bobbins, since a reduction in weight goes hand in hand with a reduction in the diameter of the supply bobbins. Thus, in the pull-off aid in accordance with the invention, the external diameter of the pull-off aid is changed in dependence upon the decreasing diameter of the supply bobbins. Thus, when the supply bobbins are full and thus have a large diameter, the pull-off aid has a larger diameter than in the case of bobbins whose diameter has decreased as a result of the drawing-off of thread. Thus, it is ensured that the threads running from the supply bobbins always have a support edge or run-off edge which prevents the threads running off bobbins, from coming into contact with the flank of their own supply bobbin or creel bobbin or the flank of the bobbin located thereabove.

Preferably, resilient elements of different strengths can be interchangeably used for the purpose of adaptation to different bobbin densities or bobbin weights. In accordance with a preferred embodiment of the invention, the inner edges of the segments have an associated cam arrangement which is disposed concentrically of the axis of the disc and which extends conically in an axial direction and against which abuts a support surface arrangement which is adjustable in an axial direction under the influence of the resilient element. Thus, this cam arrangement constitutes a control element in order to deflect the resilient force, effective in an axial direction during reduction of the weight of the bobbin, in a radial direction for the purpose of adjusting the segments.

Preferably, the segments are subjected to the influence of a tensioning element which pulls the segments radially inwardly or which acts upon them.

In order to increase the stability, and in accordance with a further preferred embodiment of the invention, the segments are displaceably mounted between a lower support disc and an upper carrier disc which is held at an axial distance therefrom, and the support disc and the carrier disc can be interconnected by means of spacer pins which at the same time constitute guide elements for the segments displaceable in a radial direction.

Preferably, each segment has at last one lug, such that the lugs of all the segments are distributed substantially uniformly around the axis of the disc, a common resilient tensioning element, preferably in the form of a garter spring or rubber ring, being placed around the lugs.

One preferred embodiment of the pull-off aid in accordance with the invention has a centering sleeve which can be slipped onto the bobbin carrier and which has an outer flange serving as a support element for a supply bobbin core, and an inner annular shoulder serving as an upper stop surface for the resilient element which is disposed within the sleeve. In a development of this kind, the centering sleeve serves as a slip-on sleeve for the lower supply bobbin onto which at least one further supply bobbin is mounted with the disc-shaped pull-off aid in accordance with the invention interposed therebetween, so that the resilient element responds to the combined reduction of weight of the two supply bobbins resulting from the reduction in the diameters thereof.

A modified embodiment of the invention has a support sleeve which can be slipped onto the bobbin carrier and which is mountable on a lower supply bobbin core and which has a lower, radially outwardly projecting annular support serving as a lower support surface for the resilient element whose upper end abuts against an inner annular shoulder of a centering sleeve which is slipped onto the support sleeve and which incorporates an outer flange serving as a support element for a further supply bobbin core. In this modified embodiment of the pull-off aid in accordance with the invention, the resilient means is only stressed by the weight of the upper supply bobbin dependent upon the diameter, so that only the change in the diameter of the upper supply bobbin is also used as a control variable for the change in the diameter of the disc-like pull-off aid.

Alternatively, from the view point of yarn technology, that is to say, the states of tension of the thread running off, intermittent adjustment of the external diameter of the disc is sufficient. Thus, for example, multi-stage adjustments or, if required, a single stage adjustment is possible which occurs when the bobbin has been reduced to approximately half its weight. The change-over point can then lie within predetermined limits which fluctuate approximately between 40% to 60% of the weight of the bobbin relative to the original weight of the fully wound bobbin. This intermittent adjustment can be achieved in that the bottom region of the cam arrangement associated with the inner edges of the segments is of circular cylindrical configuration and its upper region extends conically, so that inwardly directed radial displacement of the segments is only possible when the periphery of the outer flange of the centering sleeve enters the region of the conically extending surfaces of the cam arrangement.

In a further preferred embodiment of the invention, the segments are displaceable radially inwardly to an extent that the lower support disc forms the entire outer periphery of the pull-off aid. The peripheries of the individual segments are of arcuate configuration, so that all the segments accurately overlap one another when they are in their outer radial positions and uniformly form a circular diameter. After the individual segments have been displaced radially inwardly, that is to say, approximately upon reaching half the weight of the bobbins, the outer rims of the segments lie within the external diameter of the lower support disc which has a circular periphery and thus also ensures that the thread will slide along in a trouble-free manner.

In a further development of the invention, a further possibility of continuous or stepwise adjustment of the external diameter of the pull-off aid resides in providing the segments with substantially radially directed feeler fingers which can be brought into abutment against the outer periphery of the bobbins. In an embodiment of this kind, the diameters of the bobbins are sensed, the feeler fingers essentially replacing the cam arrangement described above.

BRIEF DESCRIPTION OF DRAWINGS

FIGS. 10 and 11 are partial axial sectional views through a further modified embodiment of pull-off aid in accordance with the invention, shown in two different operating states; and FIG. 12 is a fragmentary view, drawn to a larger scale, of a feeler finger abutting against a supply bobbin.

DETAILED DESCRIPTION OF PREFERRED EMBODIMENTS OF THE INVENTION

Figure 1:
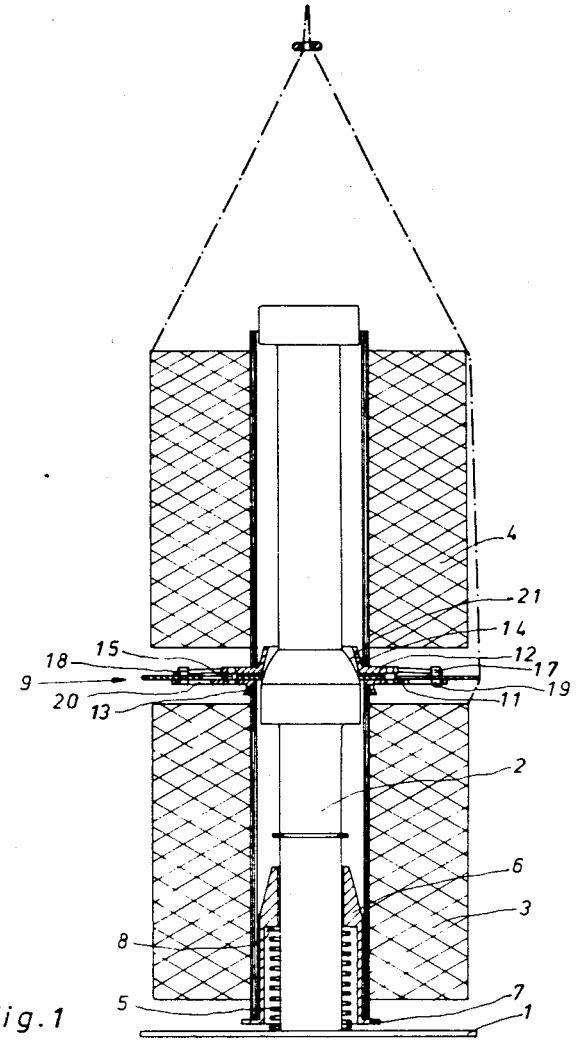
FIG. 1 is an axial sectional view of a first embodiment of pull-off aid in accordance with the invention, in conjunction with a double arrangement of two supply bobbins slipped onto a common bobbin carrier.

Referring to FIG. 1, a bobbin carrier 2 for two supply bobbins or yarn packages 3 and 4 disposed coaxially one above the other rests on base 1. A resilient element in the form of a helical compression spring 5 is slipped onto the bobbin carrier and its bottom end rests on the base 1. A centering sleeve 6 is slipped over the helical compression spring 5 onto the bobbin carrier 2 and has a lower outer flange 7 serving as a support element for the lower supply bobbin 3, and an inner annular shoulder 8 serving as an upper stop face for the helical compression spring 5 located within the centering sleeve.

Figure 3:
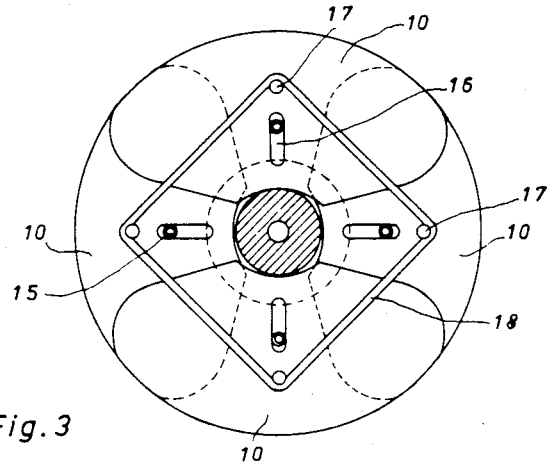
FIGS. 2 and 3 are plan views, partially axially sectioned, of the disc of variable diameter, during two different operating states.
Figure 2:
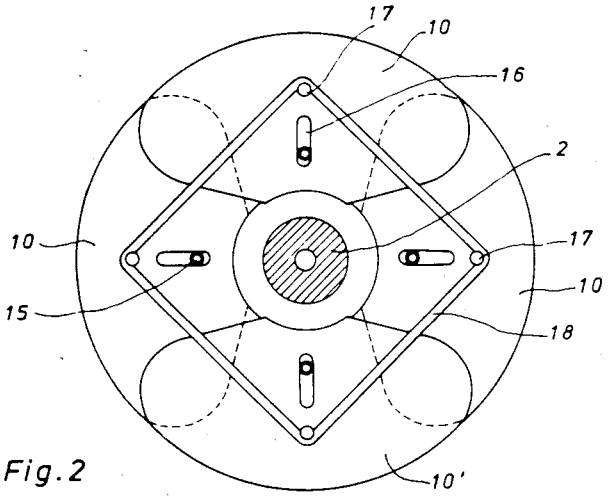

The variable diameter disc 9 of the pull-off aid is mounted onto the upper rim of the core of the lower supply bobbin 3. As shown in FIGS. 2 and 3, the disc 9 comprises overlapping segments 10 which are displaceable in a radial direction and which preferably have arcuate outer rims. The segments 10 are displaceably mounted between a lower support disc 11 and a carrier disc 12 which is held at an axial distance therefrom. The underside of the lower support disc 11 is provided with a centering extension 13 for slipping the support disc 11 onto the core of the lower supply bobbin 3. The carrier disc 12 also has a centering extension 14 for the purpose of slipping on the core of the upper supply bobbin 4.

The support disc 11 and the carrier disc 12 are interconnected by means of spacer pins 15 which at the same time serve as guide elements for the radially displaceable overlapping segments 10.

FIGS. 2 and 3 show that the variable diameter disc 9 includes, for example, four segments 10 whose outer arcuate portions correspond to at least an angular measurement of 90°. In this manner, in the state illustrated in FIG. 2 in which the disc has its largest diameter, it is ensured that the individual edges of the arcs complement one another to form approximately a closed or continuous circle. Each individual segment is provided with a guide slot 16 through which the central portion of a respective associated spacer pin 15 extends. The top face of each segment is provided with at least one spigot-like lug 17. The lugs 17 of all the segments 10 are distributed substantially uniformly around the axis of the disc of the axis of the bobbin carrier 2. A common tensioning element, preferably in the form of a garter spring or rubber ring 18, is placed around the lugs 17.

Referring to FIG. 1, the lugs 17 have downwardly extending projections 19 which extend into the guide grooves 20 in the lower support disc 11.

The inner edges of the segments 10 abut against a tapered or part-spherical annular surface on a collar 21 which is secured to the bobbin carrier 2 to form a cam arrangement extending conically in an axial direction.

The helical compression spring 5 and the vertical position of the tapered or spherical collar 21 are matched to one another such that the inner edges of the segments abut against the lower rim region of the tapered or spherical collar 21 when the supply bobbins slipped onto the bobbin carrier 2 have their maximum diameter and thus their maximum weight. This state is illustrated in FIG. 1 and, so far as the radial position of the segments 10 is concerned, in FIG. 2. The helical compression spring 5 is relieved of stress when the weight of the bobbins decreases as the diameter of the bobbins decreases, whereby the two supply bobbins are raised or lifted upwardly together with the pull-off aid disc 9. The segments 10 are pulled radially inwardly by the garter spring or rubber ring 19 as a result of the upwardly tapering configuration of the conical or spherical collar 21, that is to say, the segments 10 abut against decreasing diameters of the conical or spherical collar 21. This leads to a reduction of the diameter of the disc periphery determined by the segments 10, that is to say, to a reduction of the diameter of the outer rim of the disc 9. The maximum reduction of the diameter of the disc is attained when the support surfaces formed by the inner rims of the segments 10 have reached the top of the conical or spherical collar 21. This state is shown in the plan view of FIG. 3.

The shape of the spherical collar, or the spherical shape of the cam arrangement formed by the spherical collar 21, otherwise takes into account the fact that the weight of the bobbins decreases with the square of the diameter of the bobbins. The individual segments 10 overlap or cover one another by virtue of the fact that the individual segments are petal-shaped, i.e. they have lateral bulges, thus ensuring reliable sliding guidance of the segments.

Figure 4:
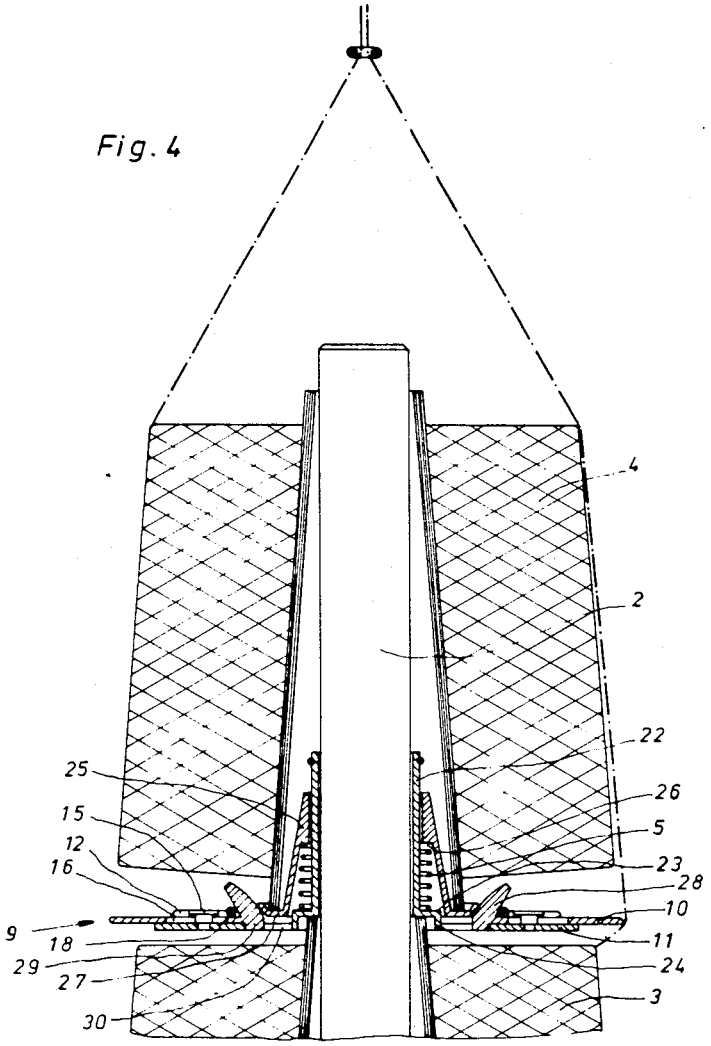
FIG. 4 is an axial sectional view through a second embodiment of pull-off aid in accordance with the invention, in conjunction with a double arrangement of two supply bobbins on a common bobbin carrier, the bobbins being fully wound.
Figure 5:
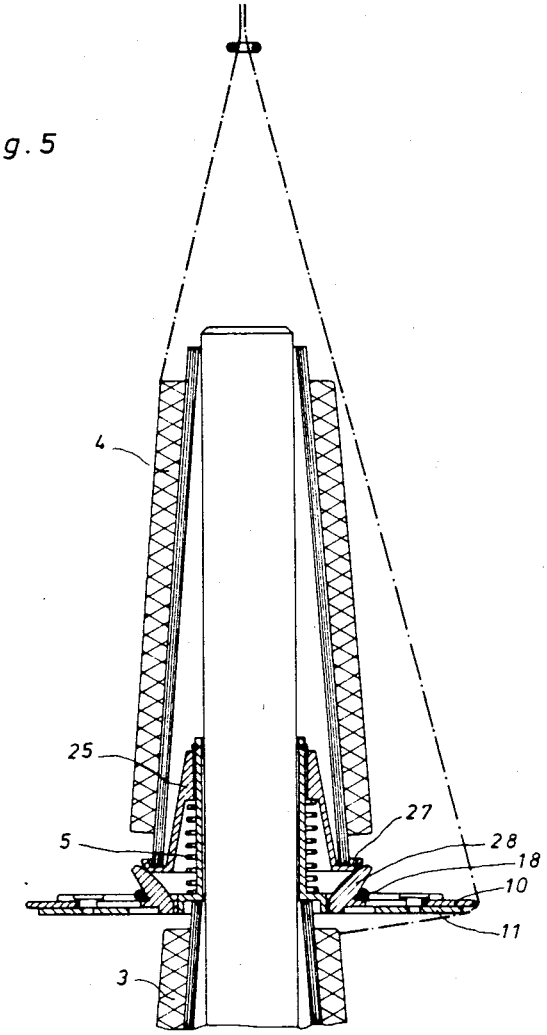
FIG. 5 is an axial sectional view corresponding to the illustration of FIG. 4, with the supply of creel bobbins almost fully unwound.

In the embodiment of the invention illustrated in FIGS. 4 and 5, only the upper supply bobbin 4 is supported by the resilient element, effective in an axial direction, in the form of the helical compression spring 5. In this modified embodiment of the invention, a support sleeve 22 is provided which can be slipped onto the bobbin carrier 2 and which has a radially outwardly projecting annular support 23 which can be received by the core of a lower supply bobbin 3. A relatively short cylindrical portion 24 of the support sleeve 22 is contiguous with the annular support 23, and a radially outwardly directed annular disc, which forms the lower support disc 11 for the radially displaceable overlapping segments 10, is in turn contiguous with the cylindrical portion 24.

The resilient element constituted by the helical compression spring 5 is received against the annular support 23 and its upper end abuts against an inner annular shoulder 26 of a centering sleeve 25 which is slipped onto the support sleeve 22 and which includes an outer flange 27 serving as a support element for the core of the upper supply bobbin 4.

The segments 10, which otherwise have the configuration illustrated in FIGS. 2 and 3, are radially displaceable between the lower support disc 11 and an upper disc 12 which is held at an axial distance therefrom. The spacer pins 15 connecting the upper disc 12 to the lower support disc 11 at the same time serve as guide elements for the segments 10 provided with the guide slots 16 which receive the pins 15.

In the embodiment of FIGS. 4 and 5, the cam arrangement extending conically in an axial direction is formed by lugs which are disposed on the inner edges of the individual segments 10 and which have outwardly flaring inner surfaces which abut against the periphery of the outer flange 27 of the centering sleeve 25. The resilient tensioning element in the form of a garter spring or rubber ring 18 is placed around the lugs 28. The underside of each lug 28 is provided with downwardly directed projection 29 which is guided in a radial guide groove 30 in the lower support disc 11.

Commencing from the state illustrated in FIG. 4, in which the upper creel bobbin 4 still has its original diameter and thus its original weight, so that the diameter of the pull-off aid disc 9 also has its greatest magnitude, the creel bobbin 4 is displaced upwardly together with the centering sleeve 26 by the helical compression spring 5 into, for example, the position illustrated in FIG. 5, as the diameter of the creel spool 4 decreases. Since the support face, formed by the periphery of the outer flange 27, for the lugs 28 forming the cam arrangement is also then displaced upwardly, the lugs 28 and thus the segments 10 are pulled radially inwardly by the rubber ring or garter spring 18, so that the outer periphery of the pull-off aid disc 9 decreases.

Figure 6:
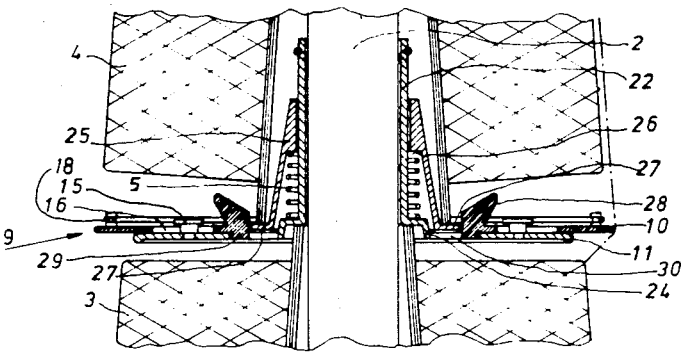
FIGS. 6 and 7 are partial axial sectional views of a modified embodiment of the invention, with the bobbin fully wound in FIG. 6, and the supply bobbin already largely unwound in FIG. 7.
Figure 7:
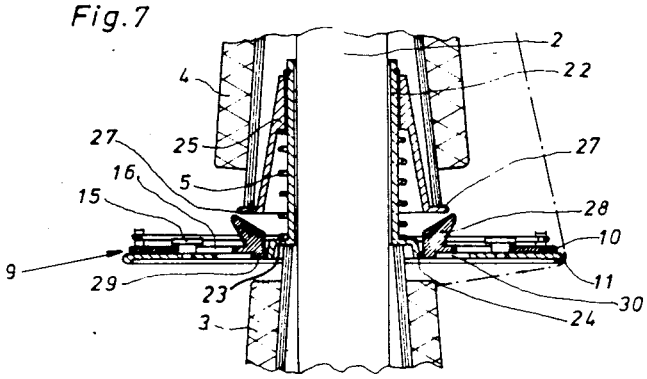

The embodiment of the invention illustrated in FIGS. 6 and 7 differs from the embodiment of FIGS. 4 and 5 in that the bottom regions of the lugs forming the cam arrangement have support surfaces which extend exactly axially and which merge into conically extending support surfaces only in the upper regions of the lugs 28. In such a case, the outer flange 27 of the centering sleeve 25 first moves along the axially extending support surfaces of the lugs 28 as the weight of the bobbins decreases, without it being possible for the segments 10 to be displaced radially inwardly. It is only when the lug support surfaces merge into outwardly directed sloping portions that the outer flange 27 of the centering sleeve 25 springs abruptly into the position illustrated in FIG. 7, the segments being pulled inwardly with a jump under the influence of the tensioning element 18 (see also FIGS. 8 and 9).

Figure 9:
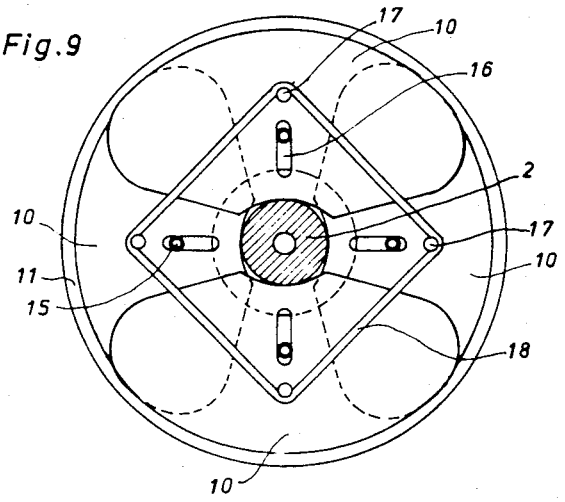
FIGS. 8 and 9 are plan views of the variable diameter disc of a device in accordance with FIGS. 6 and 7.
Figure 8:
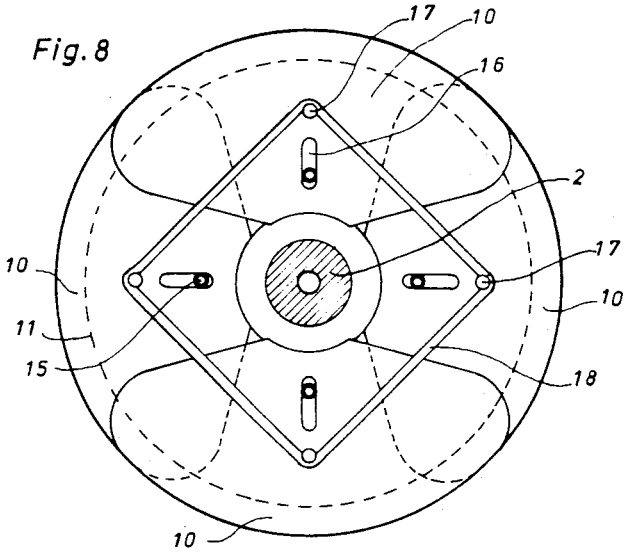

In the embodiment of FIGS. 6 to 9, the peripheries of the individual segments are of arcuate configuration, so that all the segments accurately overlap when they assume their outer radial positions and uniformly form a circular diameter (see FIGS. 6 and 8). As is shown in FIGS. 7 and 9, the segments 10 can be pulled radially inward to an extent that the outer periphery of the pull-off aid or disc 9 is formed overall by the outer periphery of the lower support disc 11 which in turn has a circular periphery, so that it is ensured that a thread can slide along in a trouble-free manner.

The resilient element formed by the helical compression spring 5 can be replaced by other springs of various spring rates and sizes to suit the sizes of bobbins.

In the further, modified embodiment of the invention illustrated in FIGS. 10 to 12, the change in the diameter of the pull-off aid disc is not effected in dependence upon the changing weight of the bobbins, but in dependence upon the decreasing diameter of the bobbins. For this purpose, each of the overlapping segments is provided with a substantially radially upwardly directed feeler finger 31 which abuts against the outer periphery of the upper supply bobbin 4 in the manner illustrated. These feeler fingers 31 essentially replace the cam arrangement, including the resilient element 5, provided in the previously described embodiments. With respect to the other structural elements, the chief difference resides only in the fact that the outer flange 27 carrying the upper supply bobbin 4 is directly supported on the lower annular support 23 of the support sleeve 22.

The segments 10 in the embodiment of FIGS. 10 and 11 can also be pulled downwardly to an extent that the outer periphery of the pull-off aid disc is formed in its entirety by the lower support disc 11.

I claim:

1. A pull-off aid for threads drawn overhead from at least two supply bobbins which are disposed coaxially one above the other, which pull-off aid comprises; at least one disc, a bobbin carrier for supporting the two supply bobbins coaxially one above the other with said disc being slidably positioned between said bobbins, said disc having a plurality of non-flexible partially mutually overlapping segments each having arcuate outer ends which segments are radially displaceably mounted on said disc so as to form, together, a circular peripheral outer edge the diameter of which is adjustable, and control means responsive to variations in bobbin weight or bobbin diameter for effecting radial displacement of said overlapping segments.

2. A pull-off aid as claimed in claim 1, wherein each said segment has at least one lug protruding therefrom, all lugs of said segments being uniformly distributed around the axis of said disc, and a common tension means placed around said lugs urging said segments radially inwardly.

3. A pull-off aid as claimed in claim 1, said pull-off aid having a resilient element, said resilient element being effective in an axial direction of the adjustable diameter disc, said resilient element being loaded by the weight of at least one of said bobbins for controlling the radial displacement of said segments.

4. A pull-off aid as claimed in claim 3, a cam arrangement disposed concentrically of the axis of said adjustable diameter disc, said cam arrangement comprising a cam surface in an axial direction and a counter surface abutting said cam surface, said cam surface and said counter surface being adjustable in an axial direction in response to said resilient element.

5. A pull-off aid as claimed in claim 4, in which said cam surface has a conical collar, and a support surface having inner edges of said radially displaceable segments which abut said collar.

6. A pull-off aid as claimed in claim 5, in which said cam surface is constituted by outwardly flaring surfaces, said outwardly flaring surfaces having inner edges including individual segments for cooperating with said counter surface which is constituted by a flange periphery which is axially displaceable by said resilient element.

7. A pull-off aid as claimed in claim 3, a centering support sleeve capable of being slipped onto said bobbin carrier and having an outer flange for cooperatively supporting the upper one of said at least two supply bobbins, and an inner annular shoulder cooperatively serving as an upper stop surface for said resilient element which is disposed within said centering sleeve.

8. A pull-off aid as claimed in claim 7, in which said centering support sleeve may be cooperatively slipped onto said bobbin carrier and mountable on said core of said lower supply bobbin, said centering support sleeve having a lower, radially outwardly projecting annular support for cooperatively receiving said resilient element, said resilient element having a lower end and an upper end, said lower end of said resilient element engaging said radially outwardly projecting annular support and said upper end abutting against said inner annular shoulder of said centering sleeve which is slipped on to said support sleeve and which includes an outer flange serving as a support for a further supply bobbin.

9. A pull-off aid as claimed in claim 1, in which each said segment includes a feeler finger, each of said feeler fingers being directed substantially axially and movable into abutment against the outer periphery of one of said bobbins.

10. A pull-off aid as claimed in claim 1, in which said segments are radially displaceably mounted, including a lower support disc and an upper carrier disc mounted a spaced axial distance from each other to receive therebetween said radially displaceably mounted segments.

11. A pull-off aid as claimed in claim 10, said lower support disc and said carrier disc being interconnected, spacer pin means mounted to interconnect said support disc and said carrier disc, said spacer pin means forming guide elements for a radially displaceable segment.

12. A pull-off aid as claimed in claim 11, said lower support disc having an underside, said lower support disc underside having a centering extension for cooperatively receiving for slipping action the said support disc, a core in said lower supply bobbin, said core cooperatively receiving the support disc for slipping action therein, and said upper carrier disc having a top face provided with a centering extension for receiving said upper supply bobbin.

13. A pull-off aid as claimed in claim 11, in which said segments are displaceable radially inwardly to an extent that said lower support disc becomes the outer periphery of said adjustable diameter disc.

14. A pull-off aid as claimed in claim 1, said disc being a lower support disc, said segments being radially displaceably mounted and guided on said lower support disc.

15. A pull-off aid as claimed in claim 14, said lower support disc having an upper side provided with a lug, said lug having a downwardly directed projection which is radially guided in said lower support disc.

* * * * *